United States Patent [19]

Caveney et al.

[11] Patent Number: 4,488,353

[45] Date of Patent: Dec. 18, 1984

[54] TERMINATION TOOLING FOR APPLYING CONNECTORS TO FLAT CABLE

[75] Inventors: Jack E. Caveney, Hinsdale; Roy A. Moody, Flossmoor, both of Ill.

[73] Assignee: Panduit Corp., Tinley Park, Ill.

[21] Appl. No.: 464,075

[22] Filed: Feb. 4, 1983

[51] Int. Cl.[3] ..... H01R 43/04

[52] U.S. Cl. ..... 29/749; 29/753; 29/759

[58] Field of Search ..... 29/749, 751, 753, 759, 29/760

[56] References Cited

U.S. PATENT DOCUMENTS

| | | | |
|---|---|---|---|
| 4,020,540 | 5/1980 | Casciotti et al. | 29/749 |
| 4,188,083 | 2/1980 | Knowles | 339/99 |
| 4,310,967 | 1/1982 | Funcik et al. | 29/749 |
| 4,332,083 | 6/1982 | Johnson, Jr. et al. | 29/749 |
| 4,393,580 | 7/1983 | Hall, Jr. | 29/749 |

*Primary Examiner*—Carl E. Hall

*Attorney, Agent, or Firm*—Charles R. Wentzel; Mark D. Hilliard

[57] ABSTRACT

Termination tooling adapted for use with a prime mover, such as a bench press, for terminating a flat cable in a connector of the type having an insulative base and cover with the base carrying a plurality of insulation displacement terminal elements extending toward the cover. The tooling includes a termination die and holding means for positioning the connector with respect to the termination die. The prime mover is connected to cause the die and the holding means to undergo reciprocal movement relative to one another. The tooling also includes stop means disposed adjacent one side of a connector positioned in the holding means for engaging the leading end of a flat cable. Cable movement means is provided for moving the leading end of the cable a predetermined distance away from the stop toward the connector prior to termination of the connector.

21 Claims, 14 Drawing Figures

TERMINATION TOOLING FOR APPLYING CONNECTORS TO FLAT CABLE

BACKGROUND OF THE INVENTION

This invention relates to connector termination tooling and, more specifically, to tooling for use with a prime mover (such as a bench press) for terminating a flat cable with mass termination insulation displacement connectors.

Mass termination insulation displacement connectors have come into increasing use because of the great savings in the labor and time they offer in comparison with the previous method of stripping the insulation from each individual conductor and applying a crimp terminal to the bared end of each. Mass termination connectors have been specifically designed for use with a flat cable wherein a series of regularly spaced conductors are embedded in a planar sheet of insulation. Such connectors typically include an aligned base and a cover with a series of regularly spaced metallic terminal elements carried by the base and extending toward the cover. The leading end of each element is bifurcated and sharply pointed for piercing the insulation of the flat cable and engaging a corresponding conductor. The base and cover are joined at each end by a post for holding the base and cover in an insertion position so that a flat cable can be inserted between the terminal elements and the cover. Examples of such prior art flat cable connectors are illustrated in U.S. Pat. Nos. 4,106,838 and 4,188,083. These connectors can be applied adjacent the end of a length of flat cable when an end termination is desired or they can be applied intermediate the ends of the cable when a daisy chain termination is required.

Such prior art flat cable connectors are typically used with a press carrying tooling have a connector holder opposing a reciprocal ram carrying a termination die for pushing the cover and base together thereby terminating the flat cable. The desired end termination is one in which the ends of the conductor in the flat cable do not extend from the connector. This reduces the hazard of subsequent short circuits and shocks to personnel and equipment, as well as enhances the appearance of the completed termination.

One way to accomplish this is to provide a cable stop on the side of the connector holder opposite the direction of cable insertion. Trimming of the excess portion of the cable may be required after termination. Trimming is very difficult and tedious to do properly, and it may cause adjacent conductors to contact one another if the trimming is performed improperly.

SUMMARY OF THE INVENTION

Among the several objects of the present invention may be noted the provision of improved tooling for use in termination of flat cable with insulation displacement mass termination connectors; the provision of such tooling which moves a flat cable abutting a cable stop a predetermined distance from the stop prior to completion of termination so that after termination, the cable end is flush or recessed with respect to the connector edge; the provision of such tooling which permits formation of a daisy chain termination closely adjacent another termination; the provision of such tooling which avoids flat cable waste; and the provision of such tooling which is fast and reliable in use, has long service life and is simple and economical to manufacture. Other objects and features of the present invention will be in part apparent and in part pointed out hereinafter in the specification and claims.

Briefly, the termination tooling includes a die for moving the connector to its termination position and holding means for positioning the connector with respect to the die. Stop means are provided adjacent one side of a connector positioned in the holding means for engaging the leading end of a flat cable. The tooling also includes cable movement means for moving the leading end of the cable a predetermined distance away from the stop and toward the connector prior to termination of the connector.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
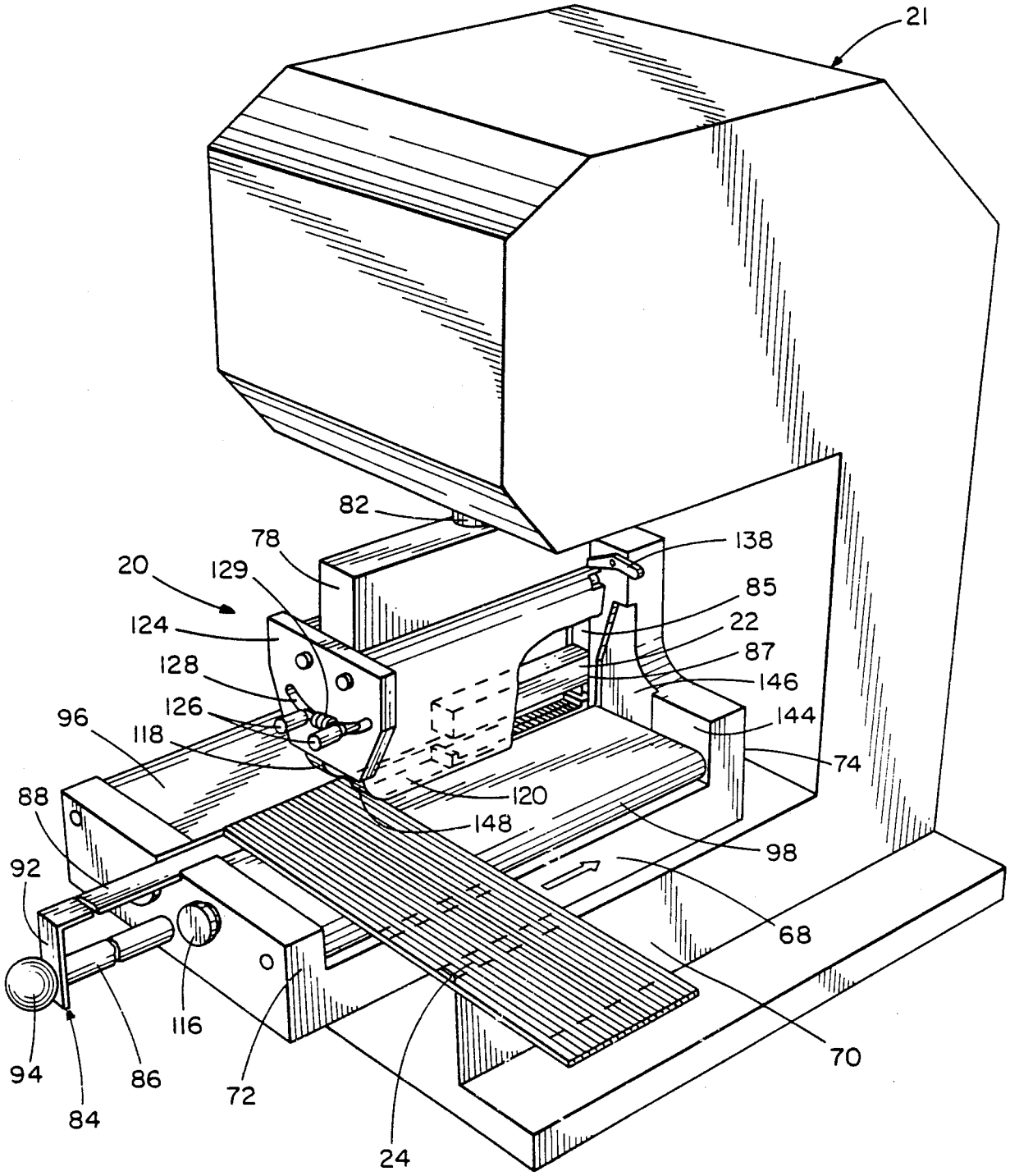
FIG. 1 is a perspective view of the tool of the present invention for termination of a flat cable with an insulation displacement connector.

Referring now to the drawings, termination tooling used with a prime mover (such as bench press 21) for applying mass termination insulation displacement flat cable connectors 22 is generally indicated in FIG. 1 by reference numeral 20. The term "prime mover" is used in its broad sense and is intended to include any means for supplying or amplifying force used in the termination of connectors 22. Such prime movers include pneumatic, hydraulic and manual presses. The tooling functions to apply connectors, one at a time, to a length of flat cable 24 in which a plurality of regularly spaced conductors 26 are embedded in a generally planar sheet of insulation having web portions 28 disposed between adjacent conductors. Termination tooling 20 is adapted to apply connectors adjacent the ends of the cable to effect end terminations and to apply connectors intermediate the cable ends when a daisy chain termination is desired.

Figure 2:
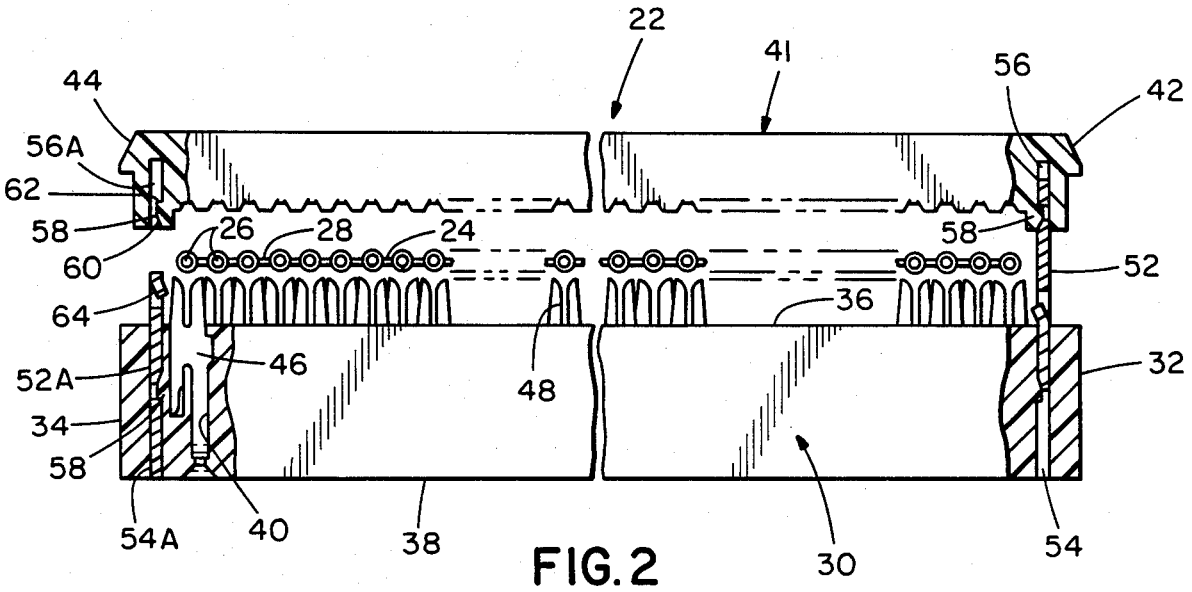
FIG. 2 is a front elevational view of the connector in its insertion position.
Figure 3:
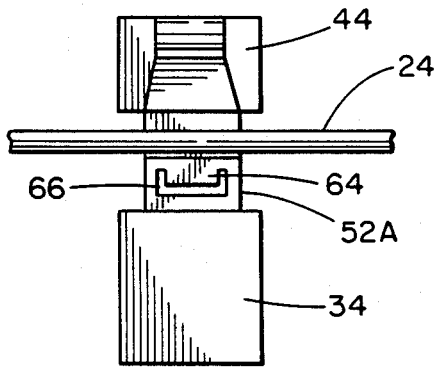
FIG. 3 is an end view of the connector of FIG. 2.
Figure 4:
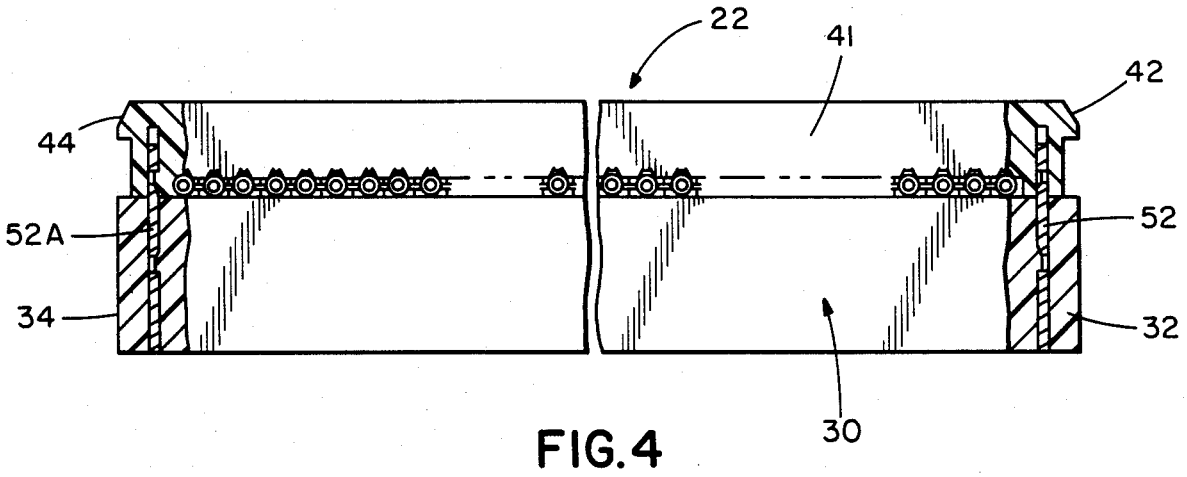
FIG. 4, similar to FIG. 2, shows the connector in its termination position.

Connector 22 is best shown in FIGS. 2–4 and includes an elongate insulative base 30 having a first end 32, a second end 34, a top surface 36, a bottom surface 38 and an array of terminal element receiving apertures 40 corresponding in number to the flat cable conductors and extending through the top and bottom surfaces. Apertures 40 are preferably arranged in two rows with adjacent apertures in each row being offset to match the spacing of the flat cable conductors. Connector 22 also comprises an insulative cover 41 overlaying the base and has a first end 42 and a second end 44. Base 30 carries a metallic terminal element 46 in each aperture 40. Each element includes a pin receiving portion disposed within the base for engaging another electrical component inserted past the bottom surface of the base, and an insulation displacement conductor termination portion 48 extending beyond the top surface toward cover 41. The conductor termination portion is bifurcated to form a conductor-receiving slot and is sharply pointed to pierce the flat cable web and engage a corresponding conductor of a flat cable upon relative movement of said flat cable and said base toward one another.

The connector also includes interconnection means joining the base and cover adjacent their respective first ends 32, 42. The interconnection means includes a first generally planar metallic clip 52 disposed in an interference fit in a through opening 54 in the base and in a closed ended opening 56 in the cover. As shown in FIG. 2, clip 52 holds the cover and base in an insertion position wherein the spacing between the terminal elements and the cover is sufficient for passage of flat cable 24.

The respective second ends 34, 44 of the base and cover also have openings 54A and 56A; however the clip 52A, which constitutes a second interconnection means, disposed at the second end of the connector is positioned, in the insertion position of the connector, to extend fully through said base so that it is spaced sufficiently from the cover to permit passage of a flat cable past the second end of the connector. Thus when the connector is in its insertion position, a flat cable can be inserted laterally of its axially direction from the second end of the connector.

The base and cover are relatively movable from the insertion position to a termination position, shown in FIG. 4, wherein the overall height of connector 22 is reduced and the various conductors of the flat cable are electrically and mechanically terminated in corresponding terminal elements. The connector also comprises latch means for holding the connector in its termination position. Each opening 54, 54A, 56 and 56A has an internal tooth 58 having a ramp surface 60 and an abutment surface 62. Also, each clip has a pair of spaced converging resilient tongues 64 defined by "U" shaped windows 66 with the tongues being bent slightly to extend from the plane of the clip to engage a corresponding internal tooth. As the connector is moved toward its termination position, clip 52 advances into opening 54 until the lower tongue passes the abutment surface of the tooth in opening 54. Also, clip 52A advances into second end cover opening 56A causing the upper tongue to be deflected by the ramp surface of the opening 56A tooth until that tongue passes the abutment surface of that tooth. As shown in FIG. 4 when the connector has moved to its termination position, each clip tongue is facing a corresponding tooth abutment surface to prevent opening of the connector.

Referring to FIGS. 1, 5, 6 and 7, termination tooling 20 includes a base 68 for mounting on the bed 70 of bench press 21. Base 68 carries an integral front wall 72 at one end thereof, and a back plate 74 extending well above the level of the front wall is attached to the other or back end of the base. Extending from base 68 and interconnecting front wall 72 and back plate 74 is a connector receiving channel 76 which constitutes holding means for positioning a connector 22 in alignment with a termination die 78 in the form of a presser foot attached to the ram 80 of the bench press by a rod 82. Thus, upon operation of the press, a connector positioned in the channel is moved to its termination position shown in FIG. 4.

Front wall 72 carries a slide 84 for moving a connector positioned in channel 76, with connector base 30 disposed above cover 41 and the open end of the connector facing front wall 72, into position for termination in a recess 85 in back plate 74. The recess serves as a connector stop and back plate 74 carries a pair of inner fixed cable stops 87 flanking connector-receiving recess 85 to limit lateral insertion of the cable to insure that each conductor of the flat cable is in alignment with its corresponding terminal element as shown in FIG. 2. As shown in FIG. 1, back plate 74 also carries a pair of outer fixed cable stops 144. A recess 146 is formed between an inner stop 87 and a corresponding outer stop 144 to receive the end of a previously applied connector as is required when a daisy chain termination is to be made closely adjacent that previous termination.

Slide 84 includes an elongate rod 86 slidably extending through an opening in front wall 72 and underlying channel 76. The slide further includes a parallel finger 88 partially overlying slide rod 86 and riding on the sides 90 of the channel for moving the connector under die 78 and into connector-receiving recess 85. Both the slide rod and finger are carried by a support plate 92 having a knob 94 for grasping by the operator.

Figure 8:
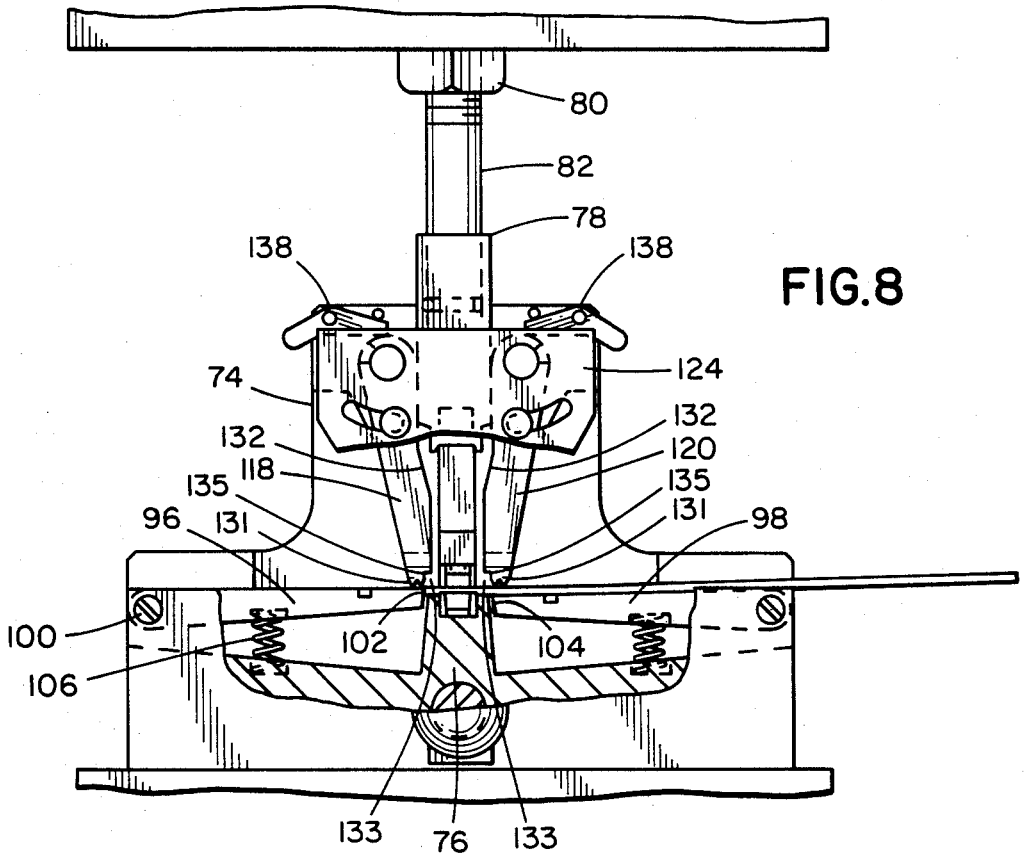
FIG. 8, similar to FIG. 7, is a partial view showing a flat cable inserted into the connector for an end termination with the leading end of the flat cable abutting a cable stop.
Figure 9:
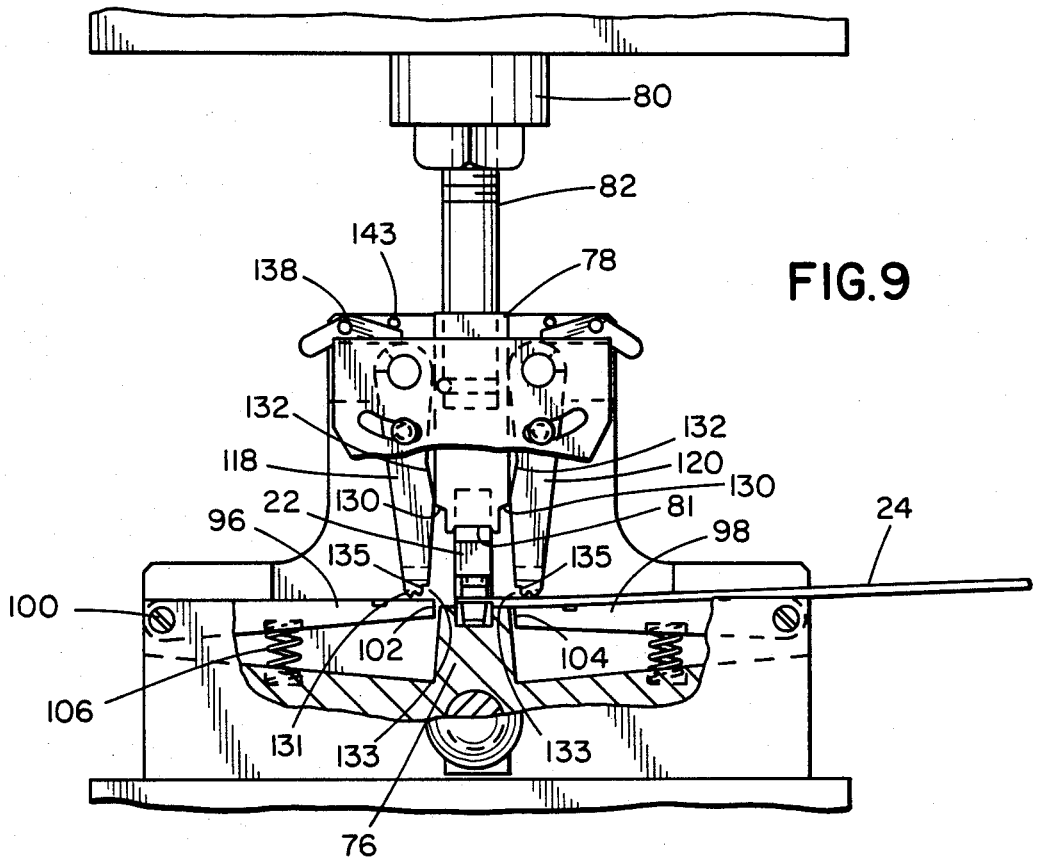
FIG. 9, similar to FIG. 8, depicts retraction of the cable away from the stop prior to termination.
Figure 10:
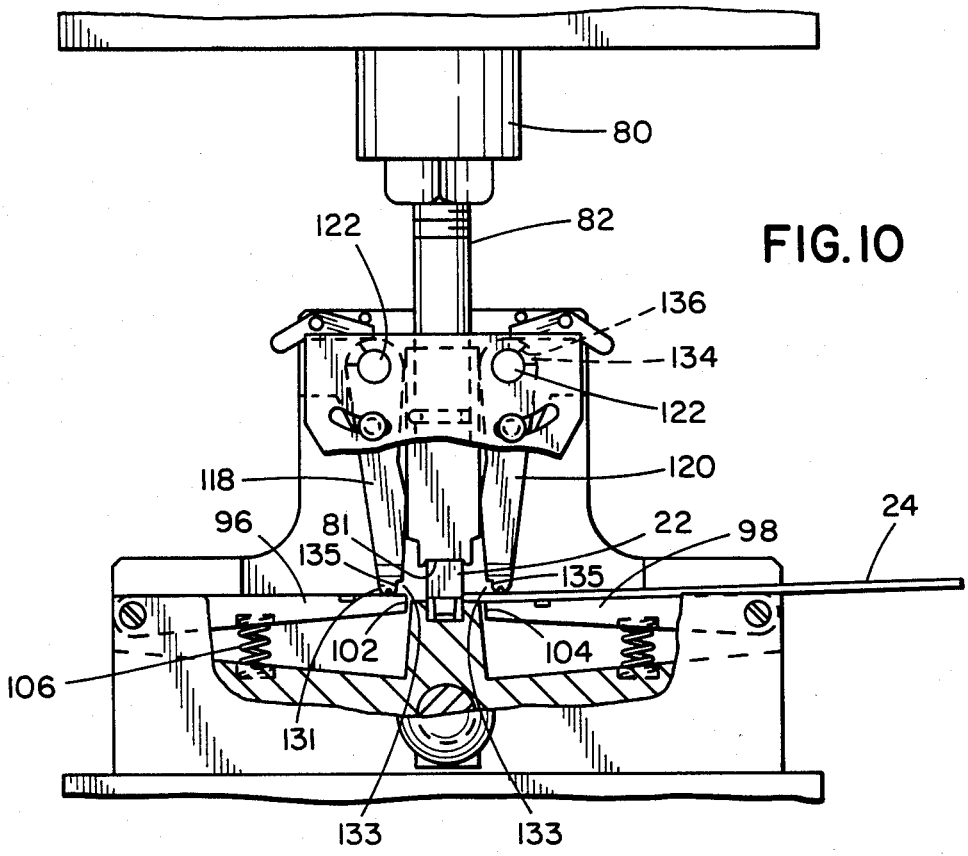
FIG. 10, also similar to FIG. 8, shows the connector fully terminated.

As best shown in FIGS. 8–10, termination die 78 has a pocket 81 for receiving connector base 30 as die 78 descends. Since channel 76 restrains the cover 41 from laterally movement, while pocket 81 inhibits such movement by the base, clip 52A will remain in registration with cover opening 56A to insure reception of the clip in the opening as the connector is moved to its termination position.

Figure 6:
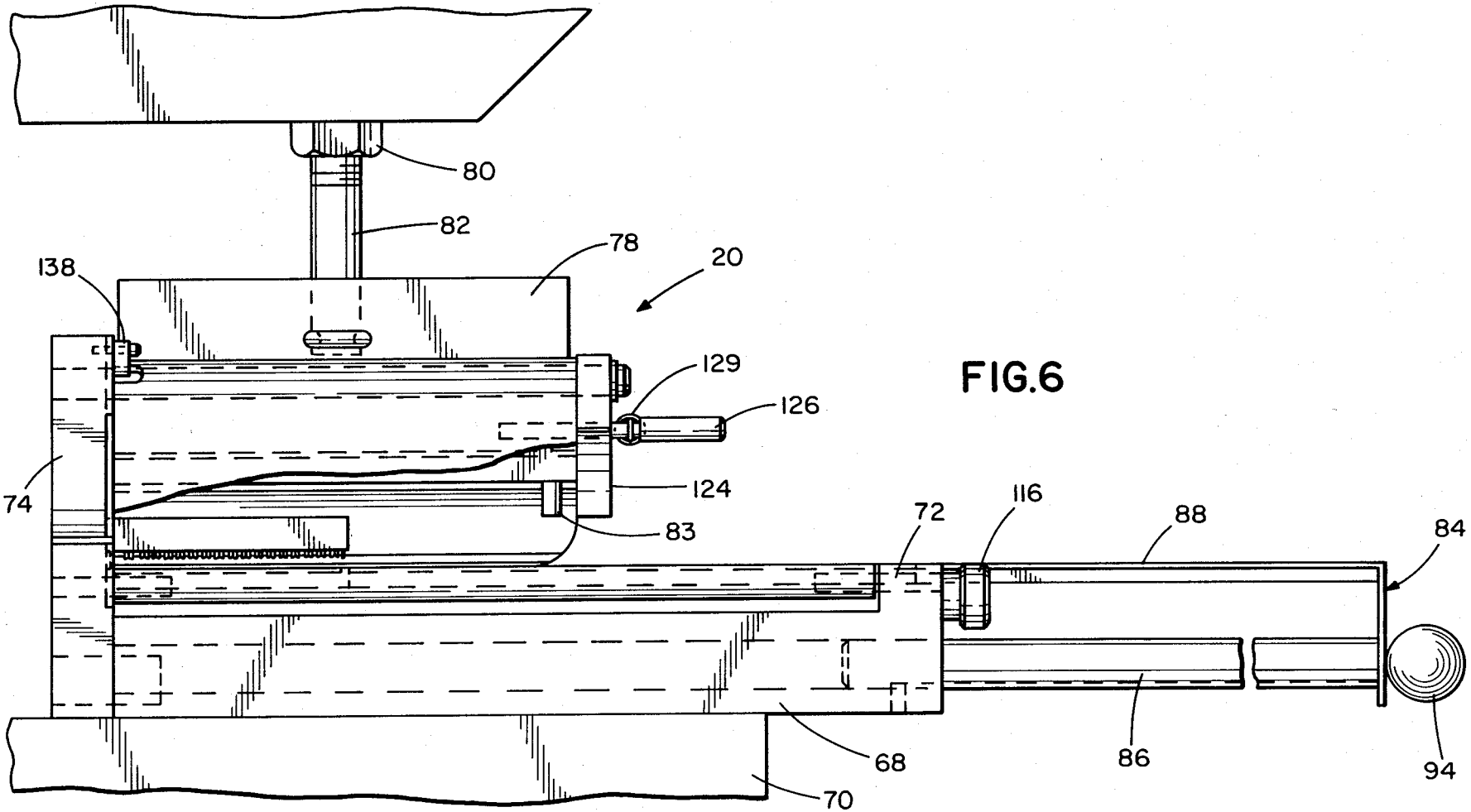

Referring to FIG. 6, termination die 78 carries adjacent its front end leveling means including a dependent leveling finger 83 for engagement with slide component 88. Finger 83 is of sufficient length to prevent the front end of the termination die from dropping closer to the channel than it would if a terminated connector were disposed in the front portion of the channel. Except for the presence of finger 83, the front end of the termination die might move closer during termination causing the die to become canted with the result that the end of the connector adjacent back plate 74 is not moved sufficiently to terminate conductors in the flat cable. It should be recognized that the tooling of the present invention is usable with connectors having various lengths. With one end of the connector disposed in recess 85 in back plate 74, only the longest connector extends sufficiently close to front wall 72 to approximate a balanced load condition on termination die 78. As one end of the connector is always located in recess 85 during termination regardless of the length of the connector, the presence of leveling finger 83 insures that when ram 80 is fully extended to place the connector in its termination position, termination die 78 is not canted.

Figure 7:
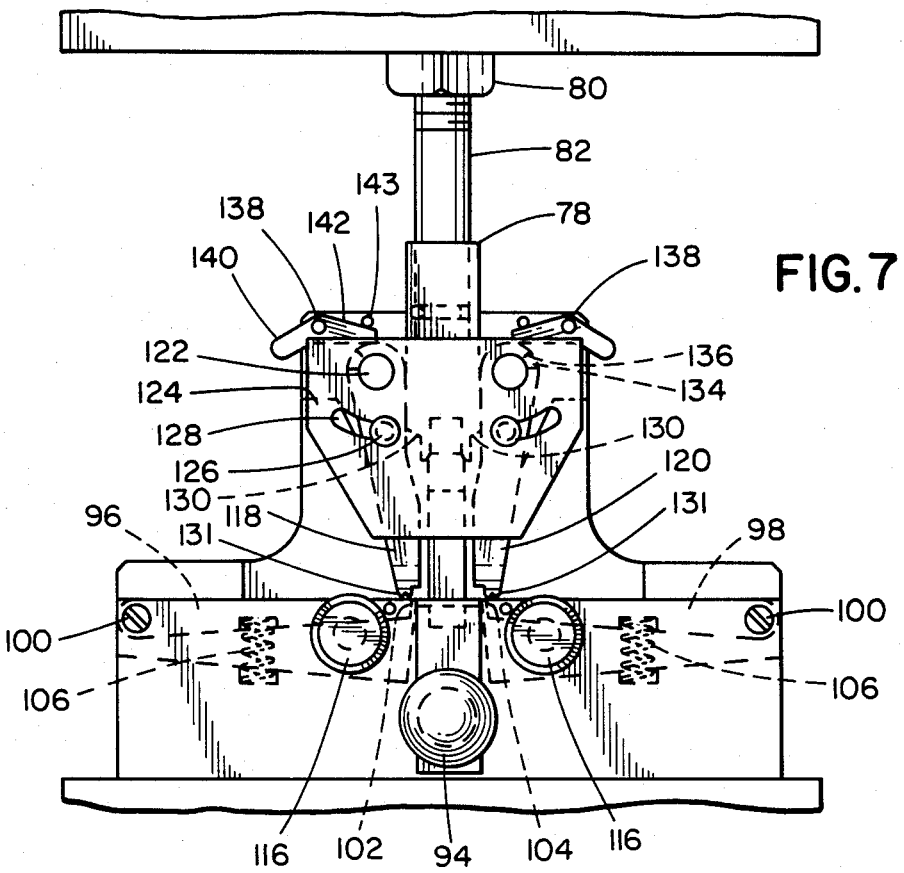

Tooling 20 also comprises a pair of cable guides 96 and 98 for directing flat cable 24 into position for insertion into a connector disposed in channel 76. One end of each guide is pivotally held by pins 100 mounted extending from front wall 72 and from back plate 74. The pins are located adjacent the sides of the base with the guides extending inwardly and terminating just short of channel 76 in respective left and right cable stops 102 and 104 flanking the channel. The cable guides are biased by compression springs 106 to extended positions, as shown in FIGS. 1 and 7, wherein stops 102 and 104 are positioned above the level of channel 76 and slide finger 88. Fixed pins 108 carried by front wall 72 are received in recesses 109 in the top surfaces 110, 112 of respective cable guides 96, 98 to limit movement of the guides away from base 68.

Figure 11:
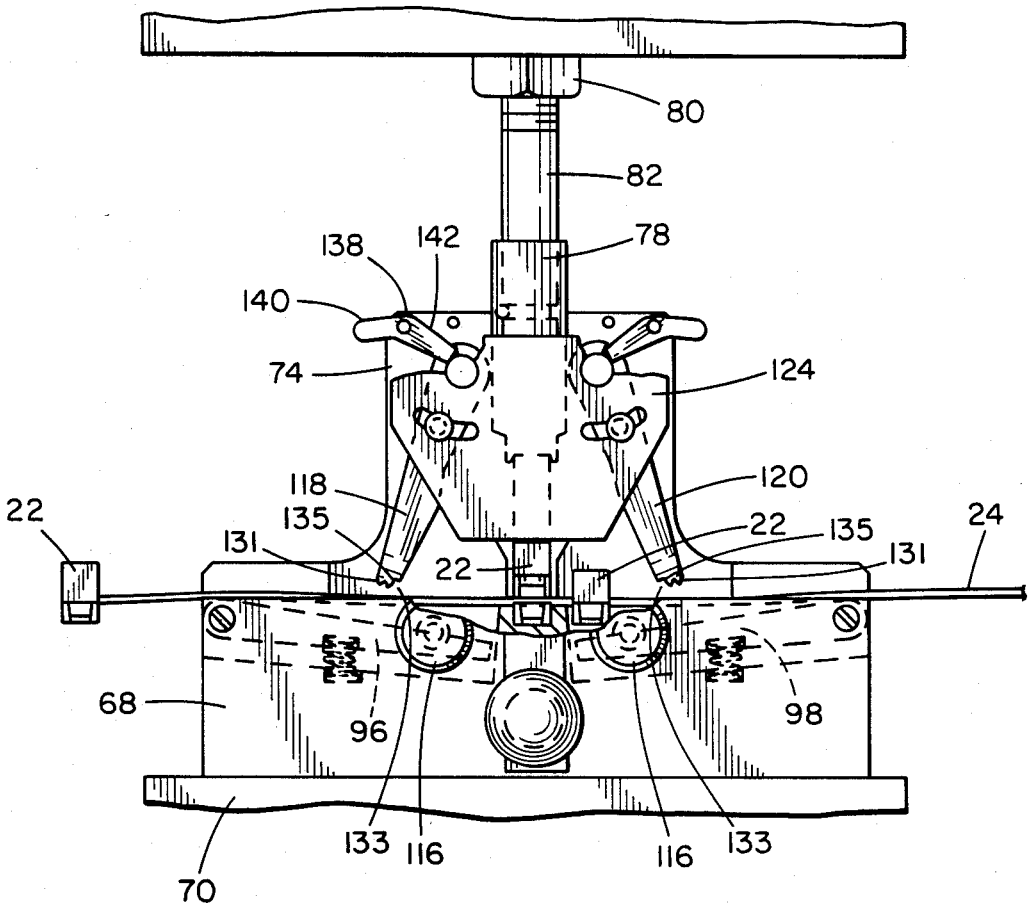
FIG. 11, also similar to FIG. 8, illustrates the cable retraction means and cable guides carrying the stops in their respective retracted or locked out positions to provide sufficient clearance for a daisy chain termination adjacent a previously terminated connector.

The guides are deflectable away from their extended position against the bias of springs 106 by the application of pressure on the top surfaces of the guides. Front wall 72 also carries a pair of retractable spring biased pins 114 which can be used to lock the cable guides and stops they carry to remote positions, as shown in FIG. 11, to provide sufficient clearance as is needed when a connector is to be terminated adjacent a previously applied connector. The cable guides are locked in this retracted position by pulling the pin 114 forward by means of a knob 116. After a wire guide is deflected beneath the level of the pin, the pin is returned to overlie the wire guide to maintain it in its remote position.

Also included in termination tooling 20 is means for effecting relative movement between (a) the end of the cable from its stopped position and (b) the connector and, more specifically, cable retraction means, carried by back plate 74, for moving the leading end of flat cable 24 a predetermined distance away from a cable stop in the axial direction of the cable toward the connector prior to termination of the connector. The cable retraction means comprises a pair of cable retraction arms 118, 120 flanking termination die 78 and a connector positioned in channel 76. The upper ends of the arms are pivotally connected to back plate 74 by support shafts 122 extending from the back plate, through the arms, and through a front plate 124. Plate 124 is held on the shafts by means of retaining rings received in annular grooves on the surfaces of the shafts. Each arm carries a post 126 extending through an arcuate aperture 128 in front plate 124.

Each arm also has a lower end terminating in cable-gripping ridges 131 spaced from a facing cable guide—in its extended position—a distance less than the thickness of cable 24. The portion of the lower end of each arm facing front wall 72 has a cam surface 148. Lateral movement of the flat cable against cam surface 148 on right cable retraction arm 120 causes deflection of right cable guide 98 from its extended position to permit lateral movement of the cable through the open end of connector 22.

A coiled extension return spring 129 interconnects posts 126 to bias cable retraction arms 118, 120 to first positions adjacent channel 76. Termination die 78 has cam surfaces 130 and each arm 118, 120 has a cam follower surface 132 facing a corresponding cam surface. As bench press 21 is operated to extend its ram 80, the termination die cams the arms to their position shown in FIG. 9 prior to termination of the connector. As the arms move apart, a cable positioned under one of the arms is retracted from the cable stop it abutted. Preferably, this distance is slightly greater than the spacing between that stop and the connector so that the end of the terminated cable is recessed inside the connector.

Referring to FIG. 7, the lower end of each cable retraction arm has an inner recess 133. In the first positions of the cable retraction retraction arms adjacent channel 76, a vertical surface 135 partially defining each recess is coplanar a cable stop 102 or 104. It will be appreciated that a recess 133 serves to receive the end of a cable should that end be bent from the axial direction of the cable. Vertical surface 135 functions to abut the bent end to position it for retraction. Thus, even if the bent end is out of alignment with cable stop 102 or 104, the vertical surface 135 functions as a cable stop.

No cable retraction is needed for a daisy chain termination and lock out means are provided for disabling arms 118 and 120 by maintaining them in their second or spaced apart positions shown in FIG. 11 wherein they do not engage the cable. This disabling means includes a recess 134, partially defined by an abutment surface 136, formed in the upper end of each arm adjacent back plate 74. The back plate pivotally carries a lock out, in the form of a bellcrank 138, for each retraction arm. Each bellcrank includes a finger-engageable handle 140 and a nose 142 for reception in a corresponding recess 134. The arms are disabled by deflecting each until a nose 142 is in alignment with a corresponding recess 134. Noses 142 bearing on abutment surfaces 136 prevent the arms from returning to their first positions under the influence of spring 129. Posts 143 are provided extending from the back plate to limit movement of the bellcranks away from the arms.

When a daisy chain connection is to be formed closely adjacent a previously terminated connector, as shown in FIG. 11, it is necessary to maintain the wire guides in their remote positions by the use of pins 114.

Figure 5:
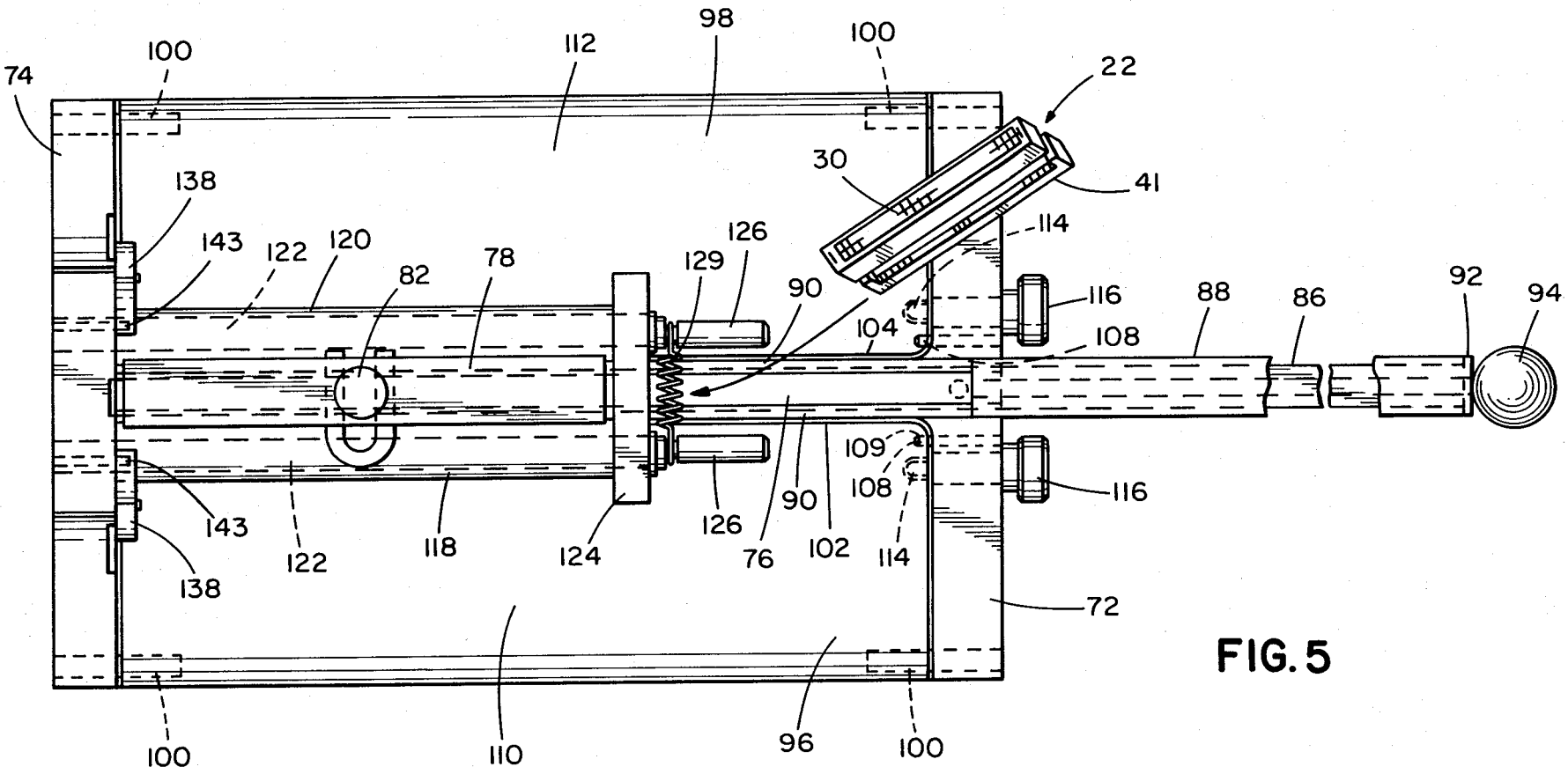
FIGS. 5, 6 and 7 are, respectively, plan, side elevational and front elevational views of the tool of FIG. 1 with certain components removed in certain views.

Operation of the termination tooling of the present invention is as follows: As shown in FIG. 5, a connector 22 is loaded into channel 76 inverted—with base 30 overlying cover 41—and with the open or second end of the connector toward front wall 72. The connector is moved underneath termination die 78 and into connector-receiving recess 85 in back plate 74 by operation of slide 84. Referring to FIG. 1, an end termination is effected to the left end of flat cable 24 by positioning the cable on the front portion of right cable guide 98 and moving the left cable end into abutment with left cable stop 102. Laterally movement of the cable against cam surface 148 of right retraction arm 120 causes right cable guide 98 to move from its extended position to provide sufficient clearance between guide 98 and right retraction arm 120 for the cable to be inserted through the open end of connector 22 while maintaining the cable end against left cable stop 102, as shown in FIG. 8.

Upon operation of bench press 21 controls, ram 80 starts to extend. Cam surfaces 130 of the termination die engage cam followers 132 of the retraction arms causing the arms to move from their first positions, see FIG. 9. Since the cable is compressively held between right cable guide 98 and the ridges of right cable retraction arm 120, the cable moves away from left cable stop 102 with arm 120 so that the left end of the cable is retracted slightly inside the envelope of the connector. The connector is moved to its termination position as the ram completes its extension, as shown in FIG. 10. The completed termination is removed from tooling 20 by merely moving slide 84 and moving the cable toward front wall 72 until the terminated connector clears the termination die. Application of an end termination to the right end of cable 24 is similar to that just described, due to the symmetry of the tooling.

Termination tooling 20 is also adapted for applying daisy chain terminations (terminations between the cable ends) where cable retraction is unnecessary. The retraction arms 118, 120 are disabled by use of the bellcranks 138, FIG. 11. The flat cable is positioned on the front portions of guides 96, 98 and laterally inserted through the open end of the connector. If the daisy chain connection is adjacent a previously applied connector, the cable guides can be retained in their remote positions by use of retractable pins 114 so that space for the terminated connector is provided.

Figure 12:
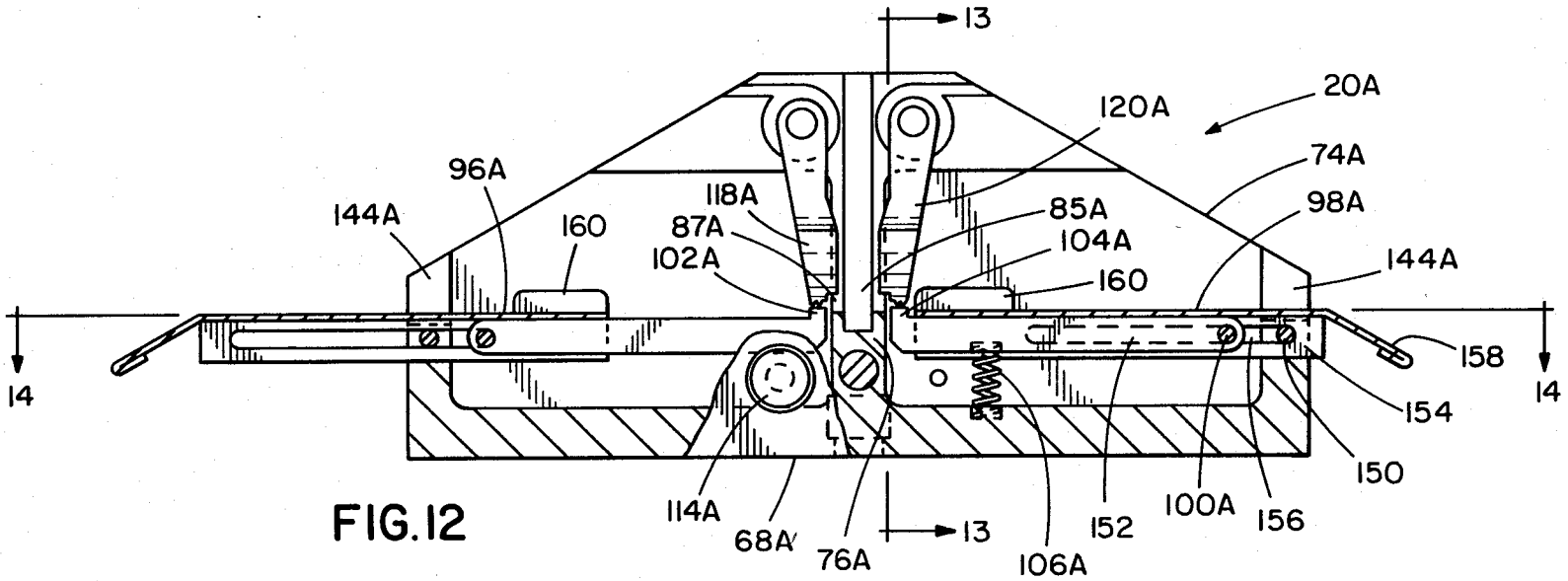
FIG. 12 is a front elevational view of an alternate embodiment of the present invention, with certain components removed.
Figure 13:
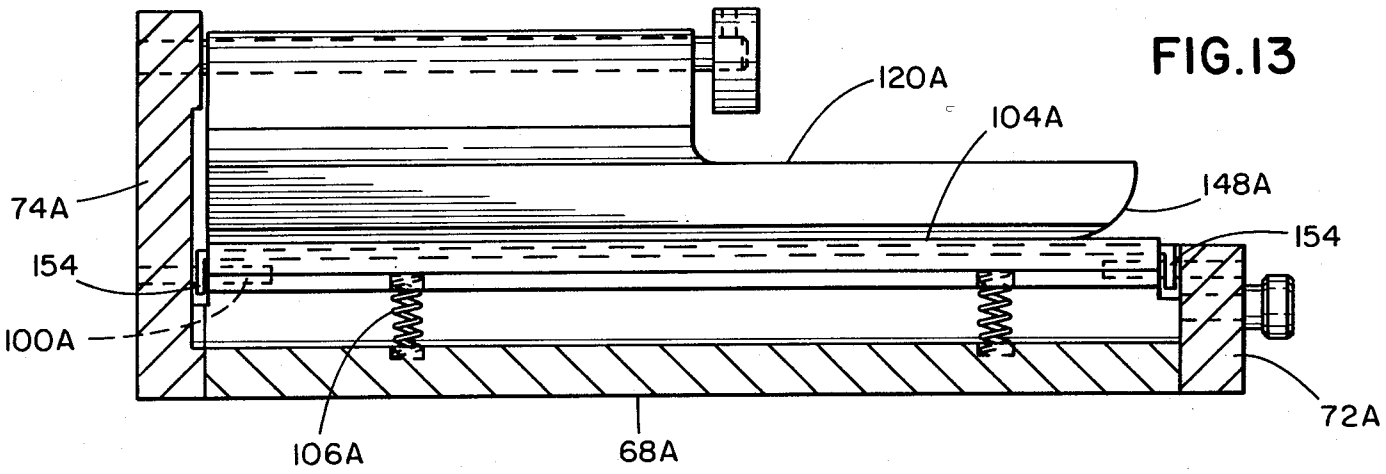
FIG. 13 is a sectional view generally along line 13—13 of FIG. 12.
Figure 14:
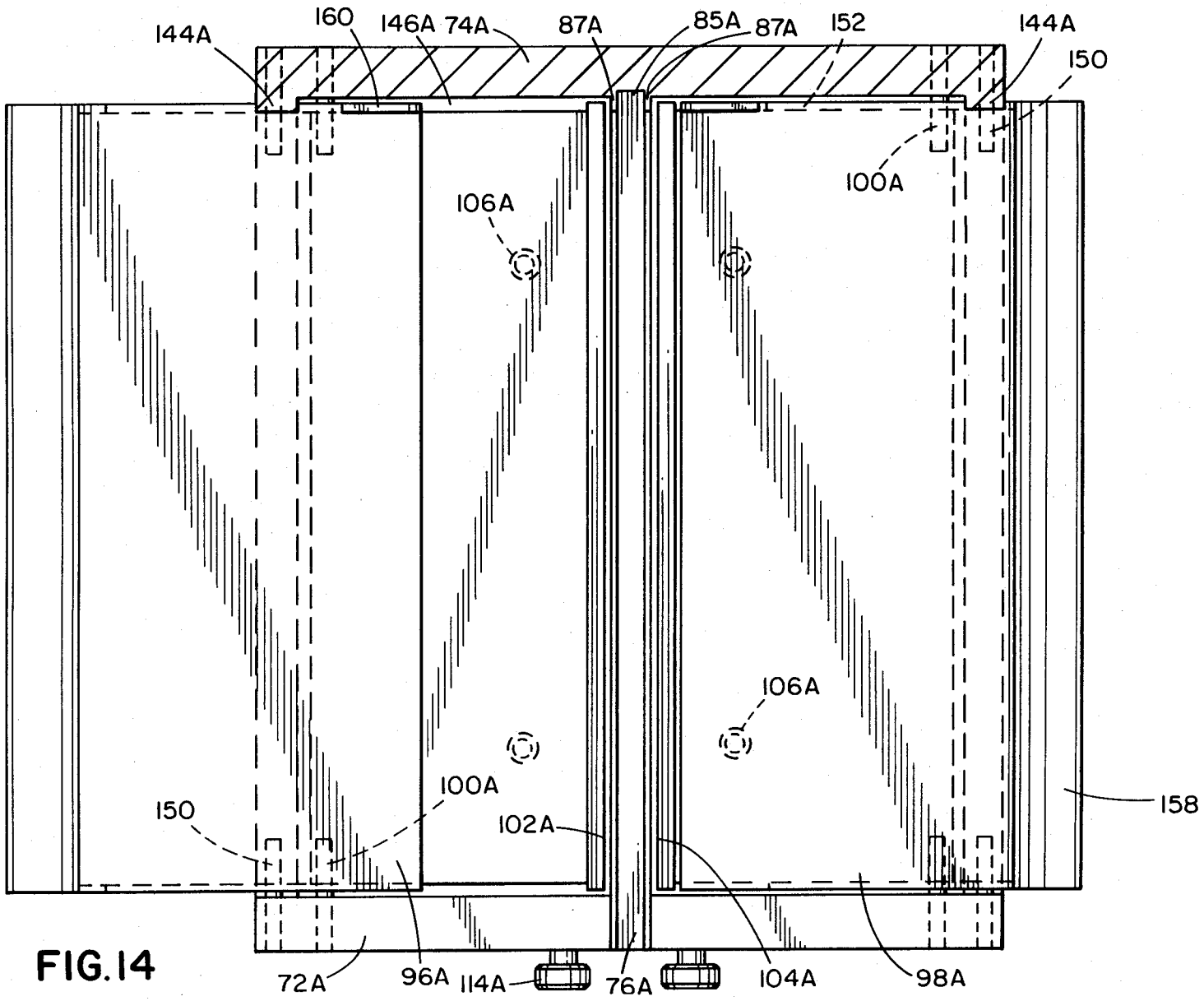
FIG. 14 is a plan of the alternate embodiment with certain components removed.

Referring to FIGS. 12–14, an alternate embodiment of the tooling of the present invention is shown by reference character 20A. Components of termination tooling 20A similar to previously described components of tooling 20 are designated by the addition of the suffix "A" to the reference numeral of the tooling 20 component. In the previously described embodiment, the distal end of left cable guide 96 served as left cable stop 102, while the inner end of right cable guide 98 was right cable stop 104. In the alternate embodiment, the left cable stop is not part of the left cable guide and the right cable stop is not integral with the right cable guide.

As the tooling is symmetrical about a plane extending through channel 76A, only the right half of the tooling need be described in detail. Mounted on front wall 72A and extending toward back plate 74A are a pair of spaced pins 100A and 150. One end of a right cable stop arm 152 is pivotally carried by pin 100A while the other end of arm 152 terminates in upwardly extending right cable stop 104A. Cable stop arm 152 is biased by spring 106A to an extended position wherein cable stop 104A engages the cable retraction ridges of right cable retraction arm 120A.

As best shown in FIG. 12, right cable guide 98A overlies cable stop arm 152, terminating short of right cable stop 104A. Guide 98A carries a dependent wall 154 having an elongate horizontal slot 156 receiving both pins 100A and 150 to limit guide 98A to translational movement. The ends of slot 156 limit movement of the guide between a cable supporting position (right cable guide 98A) and a remote position (left cable guide 96A). Each guide carries an angled extension 158 for grasping by the operator to move a guide between its positions.

Referring to FIG. 13, the front portion of right cable retraction arm 120A has cam surface 148A. Lateral movement of a flat cable against cam surface 148A causes the flat cable to move cable stop 104A against the bias of spring 106A to permit entry of the flat cable into a connector disposed in channel 76A.

Operation of the alternate embodiment tooling is similar to that described above. When a daisy chain connection is required adjacent a previously terminated connector, space for that connector is provided by moving the cable guides to their remote positions and by locking out the cable stops by use of retractable pins 114A.

As best shown in FIG. 14, cable guides 96A and 98A each carry a movable cable stop 160 adjacent back plate 74A. Each movable stop 160 lies in the same plane as an inner fixed cable stop 87A and an outer fixed cable stop 144A to properly position a flat cable with respect to a connector disposed in back wall connector-receiving recess 85A. If a daisy chain termination is required closely adjacent a previously applied termination, movement of a cable guide to its remote position causes movement of movable cable stop 160 to a position adjacent outer fixed stop 144A thus permitting the end of the previously applied connector to be received in back wall recess 146A.

Heretofore the means for effecting relative movement of a predetermined magnitude, between (1) the end of the cable from its stopped position, and (2) the connector, in the axial direction of the cable to cause the cable end to become disposed closer to the connector, has been described in terms of cable retraction. The scope of the present invention covers not only retracting a cable from a fixed stop back toward the connector. The scope of the present invention is intended to also include tooling wherein a movable cable stop is disposed between the connector and the cable. After the cable end is abutted against the stop, the stop is removed and the cable is advanced in its axial direction a predetermined distance causing the leading cable end to advance into the connector and past the terminal elements with the leading end of the cable stopping disposed flush with or slightly recessed with respect to the connector edge.

The scope of the present invention additionally is intended to include tooling wherein a connector is disposed in alignment with a cable and the cable end is in engagement with a cable stop. The cable is held from movement and the connector is moved in the axial direction of the cable a predetermined distance so that the cable is in proper relationship with the connector for termination.

Furthermore, the scope of the present invention includes tooling comprising a cable slide for moving the leading end of the cable in the axial direction of the cable with respect to a connector. The cable slide is provided with a cable clamp for holding the cable after the leading end of the cable is positioned against a cable stop. Thereafter the slide is moved a predetermined distance causing the leading end of the cable to move closer to the connector. The connector could already be in alignment with the termination die. On the other hand, an assembly including the holding means, connector, cable slide and cable could be brought to the die, as a unit.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Wire movement apparatus adapted for use with tooling for terminating wires in insulation displacement mass termination connectors having metallic terminal elements, said tooling comprising:

holding means for positioning a connector;

a termination die; and prime mover means connected to cause said die and said holding means to undergo reciprocal movement relative to one another to effect concurrent termination of a plurality of insulated conductors in said connector, said wire movement apparatus comprising:

a wire stop disposed adjacent one side of said holding means for abutting the leading ends of said wires; and wire movement means to move said wires in their axial direction a predetermined distance from their position in which they engaged said stop toward said terminal elements prior to wire termination.

2. Wire movement apparatus as set forth in claim 1 wherein said wires constitute, at least in part, a flat cable.

3. Wire movement apparatus as set forth in claim 2 wherein said wire movement means comprises wire retraction means for retracting said cable from said stop.

4. Wire movement apparatus as set forth in claim 3 wherein said wire retraction means comprises an arm disposed on the other side of said connector with respect to said stop means, said arm being engageable with a surface of said cable and being movable between a first position adjacent said connector and a second position away from said connector.

5. Wire movement apparatus as set forth in claim 2 wherein said connector comprises an insulative base and an insulative cover with said base having a plurality of spaced insulation displacement metallic terminal elements extending toward said cover and corresponding in number and position to the conductors of said flat cable, said cover and base having respective first and second ends and further having an insertion position wherein the spacing between said elements and cover is sufficient to permit insertion of said cable therebetween, said cover and base being relatively movable to a connector termination position wherein said cover and base are closer to one another than in said insertion position and each terminal element engages its corresponding flat cable conductor, a pair of corresponding ends of said cover and base in said insertion position forming an open end of said connector to enable a cable to be inserted into said connector past said open end.

6. Termination tooling adapted for use with a prime mover, such as a bench press, for terminating flat cable in a connector, said connector comprising an insulative base and an insulative cover with said base having a plurality of spaced insulation displacement metallic terminal elements extending toward said cover and corresponding in number and position to the conductors of said flat cable, said cover and base having respective first and second ends and further having an insertion position wherein the spacing between said elements and cover is sufficient to permit insertion of said cable therebetween, said cover and base being relatively movable to a connector termination position wherein said cover and base are closer to one another than in said insertion position and each terminal element engages its corresponding flat cable conductor, a pair of corresponding ends of said cover and base in said insertion position forming an open end of said connector to enable a cable to be inserted into said connector past said open end, said tooling comprising:

a termination die for moving said connector to its termination position;

holding means for positioning said connector with respect to said die,. said prime mover being connected to cause said die and a component of said holding means to undergo reciprocal movement relative to one another;

stop means disposed adjacent one side of a connector positioned in said holding means for engaging the leading end of a flat cable whereby said flat cable can be moved into said connector with a limited portion of the cable extending through the connector by inserting the flat cable past said open end of said connector while maintaining the leading end of said cable against said stop means; and cable retraction means for moving said leading end of said cable a predetermined distance away from said stop prior to termination of said connector.

7. Tooling as set forth in claim 6 wherein said stop means comprises a pair of cable stops flanking said holding means, each cable stop being movable between an extended position for limiting movement of the leading end of a flat cable with respect to a connector disposed in said holding means and a remote position to provide space for a previously terminated connector disposed closely adjacent the connector to be terminated.

8. Tooling as set forth in claim 7 wherein said cable stops are biased to their extended positions, said tooling further comprising means for locking said stops in their remote positions.

9. Tooling as set forth in claim 6 wherein said cable retraction means comprises an arm disposed on the other side of said connector with respect to said stop means, said arm being engageable with a surface of said cable and being moveable between a first position adjacent said connector and a second position away from said connector.

10. Tooling as set forth in claim 9 wherein said stop means comprises a pair of cable stops flanking said holding means, and said cable retraction means comprises a pair of arms flanking a connector positioned in said holding means.

11. Tooling as set forth in claim 9 wherein said arm is pivotally mounted and biased to said first position, said arm being responsive to operation of said prime mover to move toward its second position prior to connector termination whereby said cable is retracted said predetermined distance prior to said terminal elements terminating the conductors of said flat cable.

12. Tooling as set forth in claim 9 further comprising means for disabling said arm so that the cable is not retracted.

13. Tooling as set forth in claim 6 further comprising a cable guide disposed on the other side of said connector with respect to said stop means.

14. Tooling as set forth in claim 13 wherein said stop means comprises a pair of cable stops flanking said holding means, said tooling including a pair of cable guides flanking said holding means.

15. Tooling as set forth in claim 14 wherein a cable stop and a corresponding cable guide are integral.

16. Tooling as set forth in claim 13 wherein said cable guide and said cable retraction means cooperate to compress said cable therebetween, said cable guide being moveable between an extended position for cooperating in the compression of said cable, and a remote position.

17. Termination tooling as set forth in claim 6 further comprising leveling means for preventing said termination die from being canted upon completion of movement of said die.

18. Termination tooling as set forth in claim 17 wherein said leveling means includes a leveling finger carried by said die for limiting movement of said die toward said holding means.

19. Termination tooling as set forth in claim 17 wherein said termination die includes a first die end and a second die end and wherein a connector disposed in said holding means is closer said first die end, said leveling means comprising a leveling finger extending between said die and said holding means adjacent said second die end for limiting movement of said die toward said holding means, whereby said tooling is usable with connectors having various lengths.

20. Termination tooling adapted for use with a prime mover, such as a bench press, for terminating a flat cable in an elongate connector, said connector comprising an insulative cover and an insulative base having a plurality of spaced insulation displacement metallic terminal elements extending toward said cover and corresponding in number and position to the conductors in said flat cable, said cover and base having an insertion position for receiving said cable, said base and cover being relatively movable to a connector termination position wherein the spacing between said elements and said cover is less than in said insertion position with each terminal element engaging a corresponding conductor, said tooling comprising:

a termination die for moving said base and cover to the connector termination position;

holding means for positioning at least one of said base and cover with respect to said die, said prime mover being connected to cause said base and cover to move to said connector termination position;

stop means disposed adjacent one side of said holding means for engaging the leading end of a flat cable to limit extension of said cable beyond the connector; and cable retraction means for moving said leading end of said cable a predetermined distance away from said stop prior to termination of said connector.

21. Termination tooling adapted for use with a prime mover having a termination die for terminating a flat cable in an elongate connector including a plurality of spaced insulation displacement metallic terminal elements corresponding in number and position to the conductors in said flat cable, said tooling comprising:

holding means for positioning a connector with respect to said die;

stop means disposed adjacent one side of said holding means for engaging an end of said flat cable to position said cable with respect to said connector; and means for effecting relative movement of predetermined magnitude between (1) said cable end from its stopped position and (2) said connector, in the axial direction of said cable.

* * * * *